US005358054A

United States Patent [19]

Bert

[11] Patent Number: 5,358,054

[45] Date of Patent: Oct. 25, 1994

[54] METHOD AND APPARATUS FOR CONTROLLING STEAM BREAKTHROUGH IN A WELL

[75] Inventor: David R. Bert, Bakersfield, Calif.

[73] Assignee: Mobil Oil Corporation, Fairfax, Va.

[21] Appl. No.: 98,500

[22] Filed: Jul. 28, 1993

[51] Int. Cl.[5] ..... E21B 43/24; E21B 43/08; E21B 43/12; E21B 33/124

[52] U.S. Cl. ..... 166/386; 166/205; 166/272; 166/387; 166/181; 277/167.3; 277/236

[58] Field of Search ..... 166/205, 180, 181, 191, 166/192, 236, 242, 238, 50, 303, 272, 386, 387; 277/236, 167.3, DIG. 6

[56] References Cited

U.S. PATENT DOCUMENTS

| | | | |
|---|---|---|---|
| 2,174,795 | 10/1939 | Layne | 166/205 X |
| 2,185,522 | 1/1940 | Rollins | 166/205 |
| 2,891,623 | 6/1959 | Boss | 166/205 |
| 3,930,538 | 1/1976 | Brennan et al. | 166/205 |
| 4,114,687 | 9/1978 | Payton | 166/303 X |
| 4,368,781 | 1/1983 | Anderson | 166/272 X |
| 4,508,172 | 4/1985 | Mims et al. | 166/180 X |
| 4,640,359 | 2/1987 | Livesey et al. | 166/50 X |
| 4,645,005 | 2/1987 | Ferguson | 166/278 |
| 4,753,293 | 6/1988 | Bohn | 166/278 X |
| 4,942,923 | 7/1990 | Geeting | 166/180 X |
| 5,215,147 | 6/1993 | Grego et al. | 166/270 |

OTHER PUBLICATIONS

Catalog 1) "Hanger Packer/RHR Scab Liners", Brown Oil Tools, p. 1449, Composite Catalog of Oil Field Equipment & Services, 1982–83, World Oil, Gulf Publishing Co.

Catalog 2) "Liner Drill-in Tools"; Liner Drill-in and Gravel Pack Method; Sand Control Adapters; and Steel Flare Sand Control Adapter all for Chancellor Oil Tool, Inc., Bakersfield, Calif; circa 1993.

*Primary Examiner*—Stephen J. Novosad

*Attorney, Agent, or Firm*—Alexander J. McKillop; George W. Hager, Jr.

[57] ABSTRACT

A method and apparatus for controlling the intrusion of steam (e.g. breakthrough) from a zone of a producing formation into a slotted liner of a gravel-packed, production well of a steam flood recovery operation. An assembly including a blank, scab conduit is lowered into the upper portion of the slotted liner to effectively block those openings in the slotted liner which lie adjacent the steam intrusion zone. A seal, (e.g. deformable metal seal, metal seal rings, etc.) is provided at the upper end of the blank conduit to block upward flow between the liner and blank conduit when the blank conduit is in place. In a further embodiment, a second set of seals can be provided to block the downward flow of steam between the blank conduit and the slotted liner.

14 Claims, 4 Drawing Sheets

METHOD AND APPARATUS FOR CONTROLLING STEAM BREAKTHROUGH IN A WELL

TECHNICAL FIELD

The present invention relates to a method and apparatus for controlling steam breakthrough in a well and in one of its aspects relates to a method and apparatus which using a blank, scab conduit to seal off and control the breakthrough of steam in a production well of a steam flood recovery operation.

BACKGROUND

As is well known, "steam floods or drives" are commonly used to recover heavy hydrocarbons, e.g. heavy, viscous oil, from subterranean reservoirs. In a typical steam flood, steam is injected through an injection well(s) and flows through the formation towards a separate, production well(s). The steam heats the oil and other formation fluids, reducing their resistance to flow by lowering the viscosity of the oil. In addition, the steam provides an additional driving force to increase the flow of oil and other formation fluids toward the production well(s) where the fluids are produced to the surface.

The wells used in steam floods, both the injection and the production wells are typically completed "openhole" and then "gravel packed" to control the flow of sand and/or other particulate material from the producing formation into the wellbore. In a typical gravel pack completion, a slotted liner or the like is positioned in the wellbore adjacent the injection or production interval and is surrounded by "gravel" which, in turn, is sized to block the flow of particulate material therethrough while allowing the flow of fluids between the formation and the liner.

One of the most serious problems encountered in routine steam flood is the early breakthrough of steam at the production well. Due to the relative densities of the steam and the formation fluids, the steam tends to rise towards the top of the formation as it flows through the formation. This natural gravity segregation results in a less than 100% vertical sweep of steam through the formation and is likely to result in the steam breaking through into the production well from a zone which lies at or near the the upper end of the producing formation. Once breakthrough occurs, the injected steam will continue to take the "path of least resistance" along the swept, upper zone of the producing formation thereby continuing to bypass the unproduced, lower zones of the producing formation or interval which may lead to an early abandonment of the well wherein substantial amounts of oil remain unrecovered. Steam in the casing annulus can create excessive casing backpressure which reduces the inflow rate of oil into the wellbore. Steam breakthrough may also cause production downtime due to rod pump failure (pump galling, etc.) or stuffing box failure (excessive heat).

Several techniques have been proposed for controlling steam breakthrough in steam flood recovery operations. One is to merely redrill the production well when the steam breaks through and then set the well casing lower into the production interval to a point below the steam breakthrough zone thereby blocking off the upper zone of the producing interval which has experienced the steam breakthrough. Obviously, this technique is both time consuming and very expensive to carry out. Another known technique is to allow the fluid level in the production wellbore to build up above the level of the steam breakthrough zone. Again, this is expensive as it has been found to substantially reduce the oil production rate from the well. Another technique is to close the wellhead casing valve ( which may be connected to a wellhead casing vapor collection flowline system), thereby allowing the steam pressure to build up and create a backpressure on the steam breakthrough zone.

In other techniques, wells have been recompleted by either sidetracking a new liner in place or replacing the existing liner with a new liner wherein the new liner includes a blank section which will lie adjacent the steam zone when in place to prevent the steam from entering the liner. In each of these latter techniques, the completion interval which remains open to production is significantly reduced.

Recently, a technique has been developed wherein a resin is placed into the gravel surrounding the liner and set to block the flow of steam therethrough (e.g. see U.S. Pat. No. 5,215,147). While successful, this technique is expensive and is considered cost prohibitive where long steam breakthrough zones are involved. Also, the resin is difficult to place accurately in the wellbore and may, in some instances, seal off not only the steam intrusion zone but also a substantial portion of the production interval as well. Further, once the resin sets, it is difficult, if possible at all, to later retrieve the liner from the wellbore.

SUMMARY OF THE INVENTION

The present invention provides a method and apparatus for controlling the intrusion of steam (e.g. breakthrough) from a steam intrusion zone of a producing formation into a gravel-packed, production well of a steam flood recovery operation. In accordance with the present invention, an assembly including a blank, scab conduit is lowered into the upper portion of the slotted liner of the gravel-pack completion which lies adjacent the producing formation. The blank conduit effectively blocks those openings in the slotted liner which lie adjacent the steam intrusion zone to thereby seal off and control the breakthrough of the steam into the well.

More specifically, the assembly of the present invention includes a blank, scab conduit which has an outside diameter slightly smaller than the inside diameter of the liner and has a length sufficient to span the zone of steam intrusion. A seal adapter is affixed to the upper end of the blank conduit and carries a seal which, in turn, is adapted to prevent upward flow between the liner and blank conduit when the blank conduit is in an operable position within the slotted liner. A running tool and workstring is threaded or otherwise releasably secured to the seal adapter and the assembly is lowered on the workstring down the well and into the slotted liner. When the seal adapter comes to rest on the top of slotted liner, the blank conduit will extend into liner for a distance sufficient to span and block those openings in the liner which lie adjacent the steam intrusion zone.

The seal is then set to prevent the flow of steam upward between the conduit and the liner. While seal may be of any type, preferably, the seal comprises a deformable, metal seal, e.g. commonly-available Sand Control Adapters with brass, lead, or steel seals. This type of seal can be deformed and set by slightly reciprocating the workstring. Once the blank conduit is in place and the seal is set, the running tool is retrieved and a string of production tubing is lowered into the slotted liner to put the well back on production.

In a further embodiment of the present invention, a different type of seal (i.e. metal seal rings) is used to block flow between the blank conduit and the liner. These metal ring seals are similar to "piston rings" which are used to seal between pistons and cylinders in prime movers and the like. Each of these seals is split for assembly and is arranged in pairs so that the respective splits overlap each other. These seals are radially compressed as they are lowered in the well whereby their natural resiliency will bias the seals outward into sealing contact with the well casing. Accordingly, when the blank conduit is positioned within the slotted liner, the seals are already in a set position.

Further, this further embodiment may include a second set of metal seal rings which is positioned on the lower end of the blank conduit. These second seals will be compressed as the blank conduit moves downward into the slotted liner whereby the seals will be biased into contact with the inner surface of liner to thereby form a seal therewith. The second seals will prevent downward flow of steam between the blank conduit and the slotted liner, thereby further isolating the steam zone from the well.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
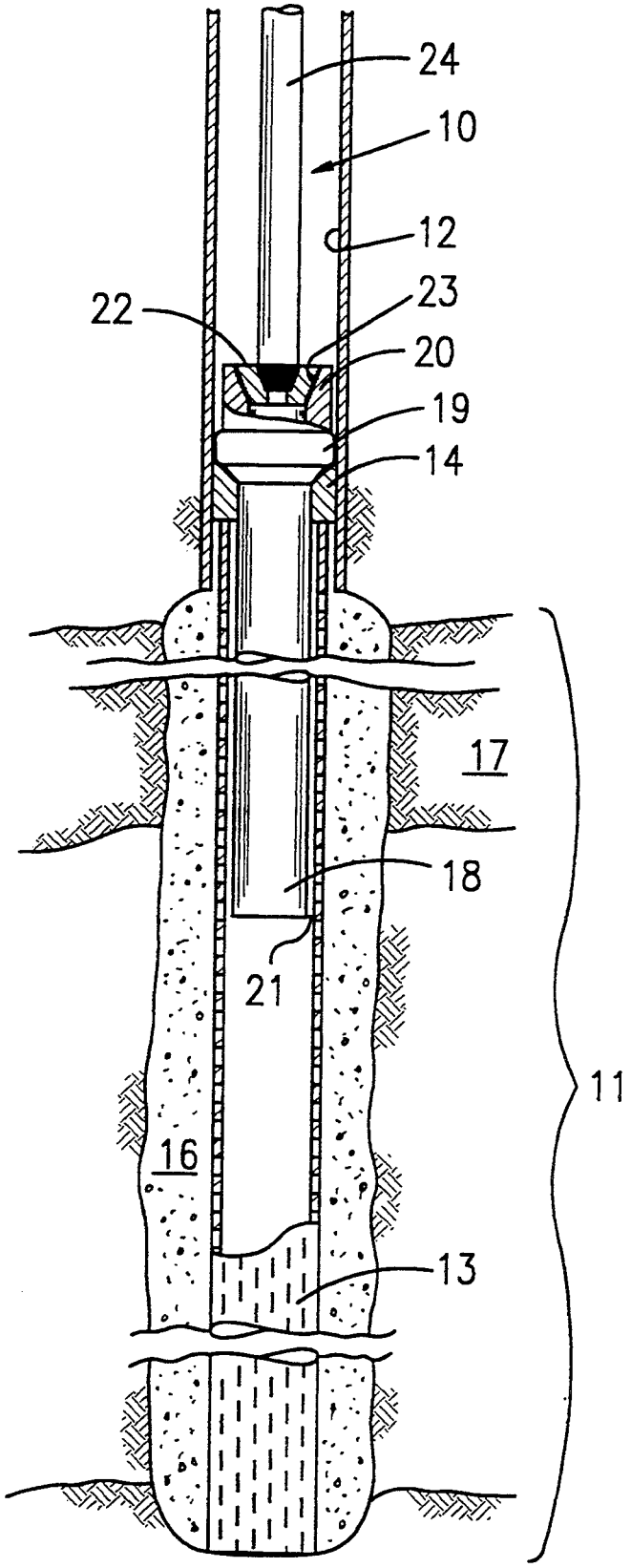
FIG. 1 is an elevational view, partly in section, of the lower portion of a typical gravel packed wellbore having a first embodiment of the assembly of the present invention installed therein.

Referring now to the drawings, FIG. 1 illustrates the lower end of a typical production wellbore 10 of the type used in a steam flood recovery operation for producing fluids, i.e. heavy oil, from a subterranean reservoir or producing formation 11. Well 10 has been completed with an open hole completion in that the wellbore is cased (i.e. casing 12 ) and cemented ( not shown ) to a point at or near the top of producing formation 11 which, in turn, has been underreamed. A slotted liner 13 is set on the bottom of the wellbore 10 and sealed at the lower end of the casing 12 with a lead, brass, or steel seal adapter (schematically shown as 14) or the liner may set above the bottom of the well by means of a liner hanger as will be understood in the art.

The term "slotted liner" is used generically herein and is meant to include and cover any and all types of permeable structures commonly used by the industry in gravel pack operations, (e.g. commercially-available screens, slotted or perforated liners or pipes, screened pipes, prepacked screens and/or liners, or combinations thereof). Slotted liner 13 has a seal 14 on its upper end which provides a seal between casing 12 and liner 13. The underreamed portion of the wellbore around liner 13 is filled with "gravel" 16 (i.e. properly sized particulate material) which allows fluid flow therethrough while substantially blocking the flow of particulate materials, as is well known in the art.

In a steam flood, steam is injected into formation 11 through an injection well(s) (not shown) which is spaced at some distance from production well 10. The steam heats the fluids (i.e. heavy oil) in formation 11 and drives the heated fluids towards production well 10. However, due to the differences in the densities of the steam and the formation fluids and/or other characteristics of formation 11, the steam has a tendency to migrate to the top of formation 11 and is almost certain to breakthrough in wellbore 10 from the upper steam intrusion zone 17 of formation 11 before rest of formation 11 (e.g. lower portion of formation 11 ) is adequately heated or swept by the steam. Obviously, this leaves a substantial portion of formation unheated and unswept and hence, substantial amounts of the oil in the formation are not recovered.

In accordance with the present invention, the intrusion of steam (e.g. breakthrough) from zone 17 is controlled by effectively blocking off those openings in slotted liner 13 which lie adjacent zone 17. This is done by lowering a blank conduit (e.g. scab casing 18) down the wellbore and into liner 13. Blank conduit 18 has a outside diameter slightly smaller than the inside diameter of liner 13 and is of a length sufficient to span zone 17 when the liner is in place.

A seal element 19, further described below, is positioned on seal adapter 20 which, in turn, is affixed to the upper end of blank conduit 18. Seal element 19 prevents flow from the upper end of the annulus 21 which is formed between liner 13 and blank conduit 18 when blank conduit 18 is in an operable position within liner 13. A running tool 22 is threaded (i.e. cooperating threads 23) or otherwise releasably secured to adapter 20 and a workstring 24 is attached to running tool 22.

In operation, when steam breakthrough is detected in wellbore 10, the extent of zone 17 (i.e. length of the production interval through which steam is intruding into the wellbore) is determined by logging or the like. Next, the apparatus in accordance with the present invention is assembled at the surface by affixing seal adapter 20 onto a length of blank conduit 18 which, in turn, is of the proper dimensions to span zone 17 and fit inside liner 13. For example, a blank conduit 18 having an outside diameter of 5½ inches would be used with a slotted liner having an outside diameter of from about 6⅝ inches to about 8⅝ inches; each of these slotted liners having an inside diameter large enough to accommodate the blank conduit 18.

Figure 2:
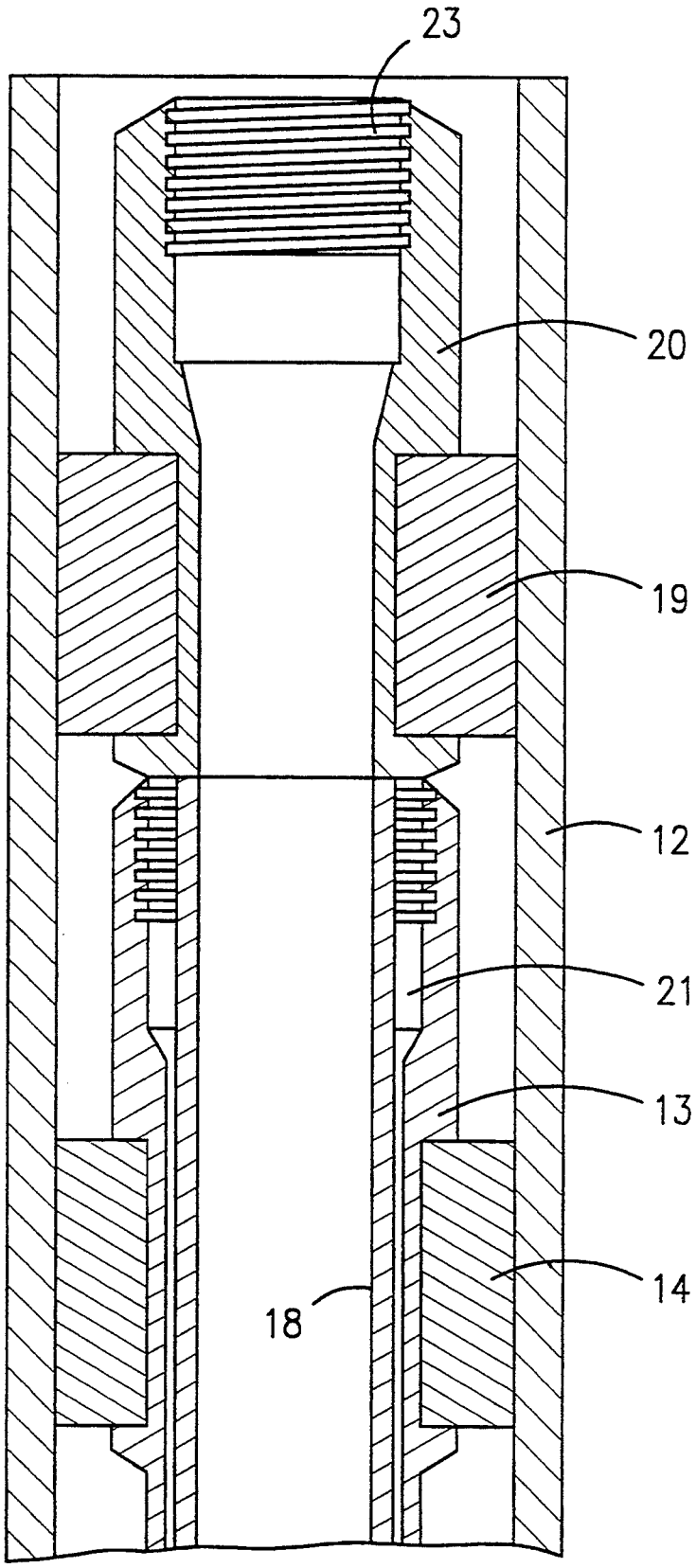
FIG. 2 is an enlarged, cross-sectional view illustrating further details of the upper end of the embodiment of FIG. 1.

The running tool 22 is threaded into cooperating threads 23 on the seal adapter 20 and the assembled apparatus is lowered on workstring 24 down well 10 and into slotted liner 13. When the seal adapter 20 comes to rest on the top of slotted liner 13 (see FIG. 2), the blank conduit 18 will extend into liner 13 for a distance sufficient to span steam intrusion zone 17 to thereby effectively block those openings in the slotted liner 13 through which steam is flowing into the liner.

Seal element 19 on the adapter 20 is then set to prevent the flow of steam upward from the annulus 21 which could otherwise provide a bypass or escape for the steam from zone 17. While seal element 19 may be of any type which is operable to block flow, preferably, seal element 19 is preferably a deformable, metal seal, e.g. brass, lead or steel seals of the type used on Sand Control Adapters, available from Chancellor Oil Tool, Inc., Bakersfield, Calif. By slightly reciprocating workstring 24 (e.g. a "jar" may be included in workstring 24), one or more downward impacts can be delivered onto seal adapter 20 which is at rest on the upper end of slotted liner 13. These downward impacts will slightly deform and axially compress the adapter (e.g. approximately 2 inches) which, in turn, will deform and radially expand metal seal 19 into contact with well casing 12 to thereby form an effective seal between the seal adapter (hence conduit 18) and casing 12. Since relatively low pressures are involved (e.g. about 200 psi), the deformed, metal seal 19 will provide an adequate seal for effectively blocking the upward flow of steam from the top of annulus 21.

Once conduit 18 is in place and seal 19 is set, running tool 22 is unthreaded from adapter 20 and is retrieved to the surface by raising workstring 24. A string of production tubing (not shown ) is then lowered down the well, through the bore of adapter 20, blank conduit 18, and into the still-open portion of slotted liner 13. Well 10 is now ready to be put back on production as will be understood in the art.

Figure 3:
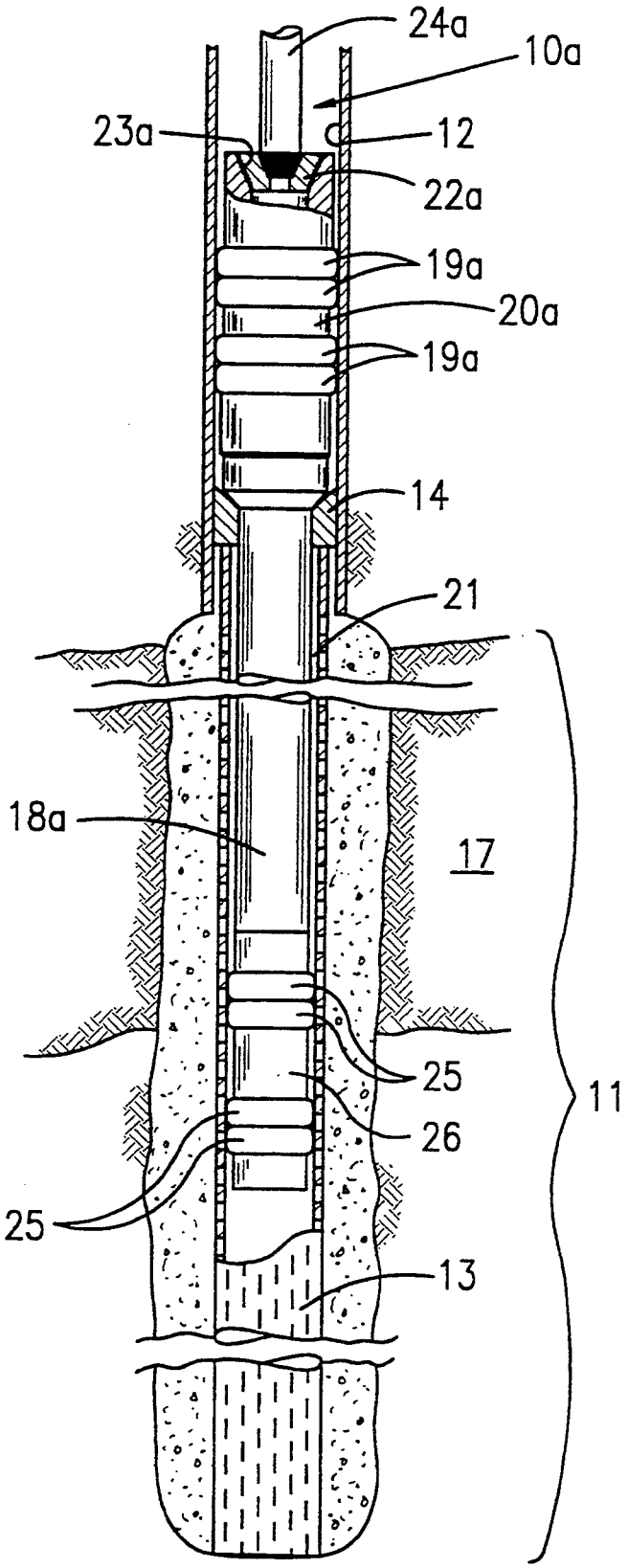
FIG. 3 is an elevation view, partly in section, of the lower end of a typical gravel packed wellbore with a further embodiment of the assembly of the present invention installed therein.
Figure 4:
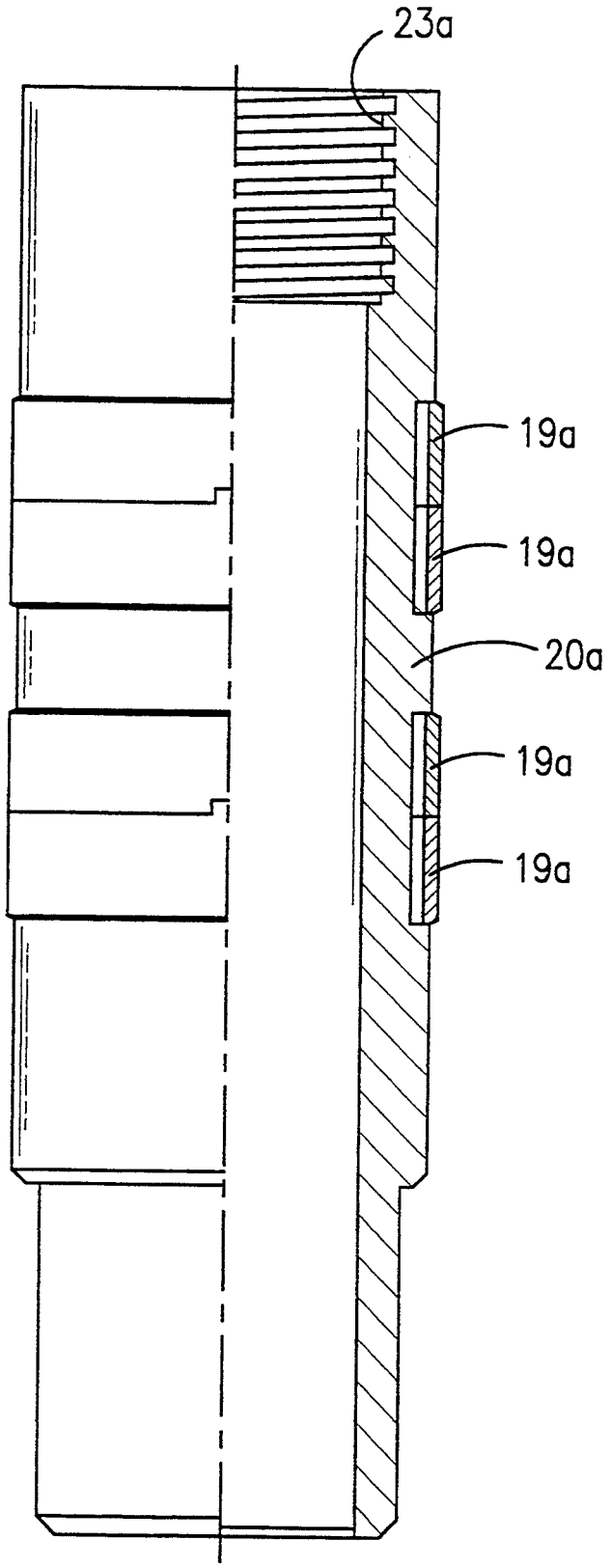
FIG. 4 is an enlarged, elevational view, partly in section, of a sealing unit which can be used with the embodiment of FIG. 3.

FIGS. 3 and 4 illustrate a further embodiment of the present invention which uses a different seal element for blocking flow through annulus 21. In this embodiment, metal seal rings **19*a* are carried on a seal adapter 20*a* which, in turn, is affixed to the top of blank conduit 18*a*. Seal elements 19*a* are of the type used to provide a seal between moving pistons (i.e. "piston rings") and their respective cylinders of prime movers and the like. Each seal 19*a* is split so that it can be assembled onto adapter 20*a* and the seals are arranged in pairs (two pairs shown in the FIGS.) so that the split in one ring is circumferentially offset from the split in the other ring to thereby prevent flow past the seals. Seal adapters, having seal rings thereon and similar to the adapter shown in FIG. 4**, have been developed for use in cyclic steam injection well tools and are commercially available from Wellhead Inc., Bakersfield, Calif.

As will be understood, the seals **19*a* are compressed inwardly when adapter 20*a* is lowered into casing 12 but will readily slide relative to casing 12 as the assembly is lowered down the well. As with other metal seal rings of this type, the natural, outward resiliency of seals 19*a* continuously bias the seals 19*a* outward radially into sealing contact with casing 12. Accordingly, when adapter 20*a* comes to rest on the top of slotted liner 13, no further manipulation of workstring 24 is needed to set seals 19*a***.

The embodiment of FIGS. 3 and 4, as shown, includes second seal adapter 26 which is affixed to the lower end of scab, blank conduit **13*a*. Adapter 26 carries additional metal seal rings 25 which are basically identical to seals 19*a*, described above, but may have a slightly smaller effective diameter. As blank conduit 18*a* moves downward into liner 13, seals 25 will be cammed and compressed inwardly whereby their natural resiliency will bias the seals 25 into contact with the inner surface of liner 13 to thereby form a seal therewith. This seal will block downward flow of steam through the lower part of annulus 21 to further isolate the interior of liner 13 from the flow of steam from zone 17**.

While the embodiment of FIGS. 3 and 4 show an assembly which includes the lower seal adapter 26, the lower seal elements are not considered necessary in most instances since it is believed that gravity will inherently keep the low density and relatively low pressured steam in the upper part of annulus 21 with little or no flow occurring from the lower end of the annulus.

Once the blank conduit **18*a* is in place within liner 13, running tool 22*a* is unthreaded from adapter 20*a* and retrieved with workstring 24*a*. A string of production tubing (not shown) is then lowered into slotted liner 18*a* to a point below second adapter 26** and the well is ready to be put back on production.

What is claimed is:

1. An assembly for controlling the intrusion of fluid into a well from an intrusion zone of a subterranean production formation into a slotted liner having openings therein, said liner being positioned in said well and extending substantially though said production formation, said assembly comprising:

a blank conduit adapted to fit within said slotted liner and having a length sufficient to extend from the top of said liner and span those of said openings in said slotter liner which lie adjacent said intrusion zone to thereby substantially block flow therethrough;

a seal adapter affixed to the top of said blank conduit; and a seal element mounted on said seal adapter, said seal adapted to block upward flow between said slotted liner and said blank conduit when said conduit is in an operable position within said liner.

2. The assembly of claim 1 wherein said seal element comprises:

a deformable, metal seal.

3. The assembly of claim 2 wherein said deformable metal seal is comprised of lead.

4. The assembly of claim 2 wherein said deformable metal seal is comprised of brass.

5. The assembly of claim 2 wherein said deformable metal seal is comprised of steel.

6. The assembly of claim 2 including:

a running tool releasably connected to said seal adapter; and a workstring connected to said running tool.

7. The assembly of claim 1 wherein said seal element comprises:

at least one, resilient metal ring seal.

8. The assembly of claim 7 including:

a second seal adapter affixed to the lower end of said blank conduit; and a second seal element mounted on said second seal adapter.

9. The assembly of claim 8 wherein said second seal element comprises:

at least one, resilient metal seal ring.

10. A method for controlling the intrusion of steam from an intrusion zone of a formation into a slotted liner of a gravel-packed interval of a wellbore, said slotted liner having openings therein and extending substantially through said gravel-packed interval, said method comprising:

positioning a length of blank conduit into said slotted liner, said blank conduit adapted to fit within said slotted liner and having a length sufficient to extend from the top of said liner and span said intrusion zone whereby said blank conduit will substantially block flow through those of said openings which lie adjacent said intrusion zone thereby preventing flow of steam from said intrusion zone into said liner; and setting a seal element at the upper end of said blank conduit to thereby block upward flow between said liner and said blank conduit.

11. The method of claim 10 wherein said seal element is a deformable metal seal which is set by impacting said conduit.

12. The method of claim 10 wherein said seal element is a metal seal ring which is set by its natural resiliency.

13. The method of claim 10 including:

blocking downward flow between said liner and said blank conduit.

14. The method of claim 10 wherein the step of positioning said length of blank conduit comprises:

lowering said blank conduit into said slotted liner from the surface on a workstring; and removing said workstring from said well after said blank conduit is installed.

* * * * *